US006273973B1

(12) United States Patent
Parayil et al.

(10) Patent No.: US 6,273,973 B1
(45) Date of Patent: Aug. 14, 2001

(54) STEELMAKING PROCESS

(75) Inventors: Thomas R. Parayil, New Kensington; David S. Bergstrom, Natrona Heights; Raymond A. Painter, New Kensington, all of PA (US)

(73) Assignee: ATI Properties, Inc., Gardena, CA (US)

( * ) Notice: Subject to any disclaimer, the term of this patent is extended or adjusted under 35 U.S.C. 154(b) by 0 days.

(21) Appl. No.: 09/452,794

(22) Filed: Dec. 2, 1999

(51) Int. Cl.[7] ..... C21B 8/00; C21B 9/00

(52) U.S. Cl. ..... 148/542; 148/547; 164/509; 164/515; 164/476; 164/477

(58) Field of Search ..... 148/542, 547; 164/509, 515, 476, 477

(56) References Cited

U.S. PATENT DOCUMENTS 3,847,683 11/1974 Sastri .
4,021,272 5/1977 Asai et al. .
4,180,420 12/1979 Sastri et al. .
5,433,801 7/1995 Althaus et al. .

FOREIGN PATENT DOCUMENTS

1400412 * 7/1975 (GB) .

* cited by examiner

*Primary Examiner*—Deborah Yee
(74) *Attorney, Agent, or Firm*—P. J. Viccaro

(57) ABSTRACT

A process for producing a steel includes subjecting at least a portion of a melt of the steel to electroslag remelting and, in a subsequent step, heating the steel to a temperature at least as great as the lowest temperature at which all carbides that can form in the remelted steel will dissolve and no greater than the nil ductility temperature of the of the remelted steel, and maintaining the temperature for a period of time sufficient to dissolve primary and clustered carbide particles in the remelted steel greater than 15 micrometers in length. A novel martensitic stainless steel also is disclosed including 0.65 to 0.70 carbon; 0 to 0.025 phosphorus; 0 to 0.020 sulfur; 0.20 to 0.50 silicon; at least one of greater than 0.0004 boron and greater than 0.03 nitrogen; 0.45 to 0.75 manganese; 12.7 to 13.7 chromium; and 0 to 0.50 nickel.

18 Claims, 9 Drawing Sheets

STEELMAKING PROCESS

CROSS-REFERENCE TO RELATED APPLICATIONS

Not Applicable

FEDERALLY SPONSORED RESEARCH

Not Applicable

TECHNICAL FIELD AND INDUSTRIAL APPLICABILITY OF THE INVENTION

The present invention is directed to martensitic stainless steels. The present invention is more particularly directed to martensitic stainless steels which may, through appropriate processing, develop a microstructure suitable for the production of razor blades. The present invention also is directed to a process for processing a martensitic stainless steel to a gage and with a microstructure suitable for the production of razor blades.

DESCRIPTION OF THE INVENTION BACKGROUND

Because the process of shaving places the blade steel in contact with moisture, stainless steel is a natural selection for razor blade applications. Razor blades typically are fabricated from a coil of stainless steel that has been rolled to a strip of very thin gage (less than ten mils) and that has been slit to an appropriate width. The coiled steel strip is uncoiled, sharpened, hardened, appropriately coated, and welded to a blade support so that it may be manipulated against the skin.

Steel used as razor blade material preferably includes secondary carbide particles that are of a uniform generally spherical shape, that have uniform size less than 15 micrometers and uniform distribution, and that are present in a concentration of about 50–200 carbide particles per 100 micrometers square as observed at high magnification. If secondary carbide particles within the steel are not of uniform size and distribution, for example, the steel may distort during the heat treatments used in razor blade fabrication. Distortion of the steel during heat treatment is referred to as "dish", and only a minor amount of dish is cause for rejecting the steel. The steel preferably also is substantially free of primary carbides or clusters of carbides that exceed 15 micrometers in length. It is also preferred that the steel is essentially free of non-metallic microinclusions and does not include regions of segregation, carburization, or decarburization. Primary carbide particles and non-metallic microinclusions typically are large in size, brittle in nature, and have a low cohesion to the steel matrix. As such, they may cause "tear outs" during the sharpening of the steel. A tear out occurs during sharpening when the carbide particle or inclusion is pulled from the steel, leaving a jagged surface that can be felt during shaving.

In addition to meeting the foregoing microstructural criteria, stainless steels used in razor blade fabrication also must satisfy additional qualitative and quantitative criteria established by the individual razor blade manufacturers and which demonstrate a suitability for shaving. Certain of those additional criteria are evaluated after samples of the steel strip have been modified by the manufacturer to include a sharpened edge, additional martensite (i.e., enhanced hardness), and a non-metallic coating.

Razor blades are commonly fabricated from strip of certain high carbon type 420 stainless steels. (Type 420 steels have the nominal composition 0.15 min. carbon, 1.00 max. manganese, 1.00 max. silicon, and 12.0–14.0 chromium, all in weight percent.) The type 420 steels that may be used as razor blade material must have a chemistry that may be processed to meet the above microstructural requirements. The steels also must be capable of processing to a uniform thin gage strip, typically 34 mils in thickness, a uniform width, and have no appreciable surface defects or edge checking. Because the steel strip typically is produced from large ingots weighing thousands of pounds, the overall thickness reduction necessary to achieve 3–4 mils thickness during processing is extreme. The need to achieve a thin gage final material while also meeting the other requirements discussed above necessarily complicates the processing of the material and limits the array of suitable heat chemistries and processing regimens.

Accordingly, there is a need for a method of processing type 420 and other stainless steels to a uniform thin gage while satisfying the above microstructural criteria. There also is a need for improved martensitic stainless steel alloys that demonstrate a suitability for razor blade applications.

SUMMARY OF THE INVENTION

The present invention addresses the above-described needs by providing a process for producing a martensitic stainless steel to a gage and with a microstructure and other properties suitable for application as razor blade material. The process includes the step of subjecting at least a portion of a melt of a martensitic stainless steel to an electroslag remelting (ESR) treatment. In a step subsequent to the ESR treatment, the steel is heated to a temperature at least as great as the lowest temperature at which all of the carbides that may form in the steel will dissolve and no greater than the nil ductility temperature of the steel. The steel is held at that temperature for a period of time sufficient to dissolve all primary carbide particles in the steel that are greater than 15 micrometers in length. Subsequent to the heat treatment, the steel may be reduced to a strip of a desired gage (typically, less than 10 mils for razor blade applications) through a series of hot and cold reduction steps. The steel may be annealed between the cold rolling steps to appropriately recrystallize the cold worked structure within the steel and inhibit breakage or unacceptable checking during the cold reductions.

The process of the present invention may be applied to, for example, a steel having the chemical composition of a type 420 martensitic stainless steel, and is particularly well-suited for type 420 stainless steels including at least the following, all in weight percentages:

0.65 to 0.70 carbon;

0 to 0.025 phosphorus;

0 to 0.020 sulfur;

0.20 to 0.50 silicon;

0.45 to 0.75 manganese;

12.7 to 13.7 chromium;

0 to 0.50 nickel; and incidental impurities.

The present invention also is directed to certain novel martensitic type 420 stainless which form a part of the present invention and which include at least the following, all in weight percentages:

0.65 to 0.70 carbon;

0 to 0.025 phosphorus;

0 to 0.020 sulfur;

0.20 to 0.50 silicon;

at least one of greater than 0.0004 boron and greater than 0.03 nitrogen;

0.45 to 0.75 manganese;

12.7 to 13.7 chromium;

0 to 0.50 nickel; and incidental impurities.

Such steels may be advantageously processed by the method of the invention to include a microstructure that is substantially free of individual and clustered primary carbides exceeding 15 micrometers in length and an average of 50–200 secondary carbide particles per 100 micrometer square region when viewed at high magnification.

The reader will appreciate the foregoing details and advantages of the present invention, as well as others, upon consideration of the following detailed description of embodiments of the invention. The reader also may comprehend such additional details and advantages of the present invention upon using the invention.

BRIEF DESCRIPTION OF THE DRAWINGS

The features and advantages of the present invention may be better understood by reference to the accompanying in which.

DESCRIPTION OF EMBODIMENTS OF THE INVENTION

Figure 1:
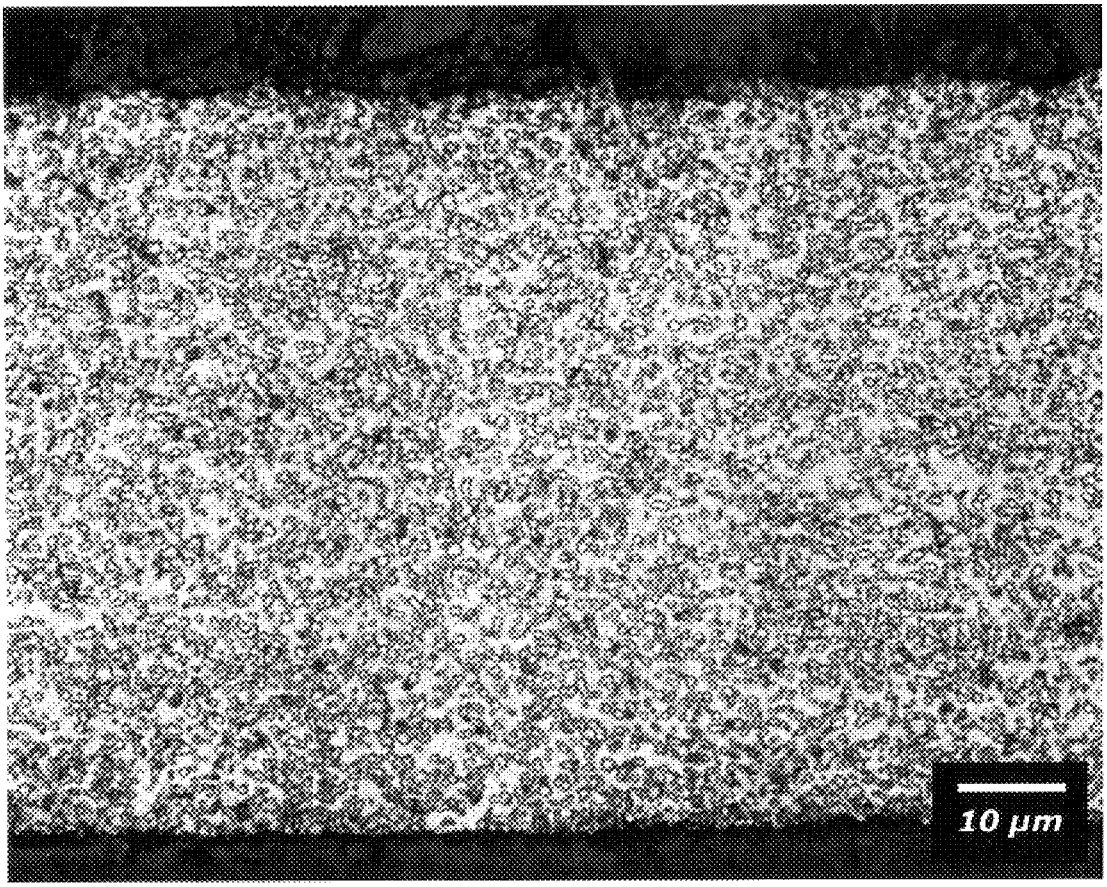
FIG. 1 is a photomicrograph (1500×) of a sample of heat RV1662 material after a final anneal at just under 0.003 inch thickness.

The present invention is directed to a process for producing stainless steel strip suitable for razor blade applications. The characteristics of such strip include uniform thin gage (less than 10 mils) and the microstructural and other properties described above. As processed, the steel strip preferably has a microstructure that is substantially free of nonmetallic microinclusions and large (greater than 15 micrometers) primary carbides and clustered carbides. The steel strip also preferably includes a generally uniform distribution of small secondary carbides and lack surface decarburization, and the strip must maintain tight dimensional tolerances (for example, tolerances for gage, width, dish, and camber are very tight). Typically, type 420 martensitic stainless steels are used in razor blade applications. Type 420 steels commonly include 0.2–0.4 weight percent carbon, but may include significantly higher levels of carbon when produced for razor blade applications.

A focus of the inventors' investigations was high carbon type 420 stainless steels having the base and aim chemistries in Table 1.

TABLE 1

| Element | C | Mn | Si | P | S | N | B | Cr | Ni | Fe |
|---|---|---|---|---|---|---|---|---|---|---|
| Base Chemistry | 0.65–0.70 | 0.45–0.75 | 0.20–0.50 | 0.025 max. | 0.020 max. | — | — | 12.7–13.7 | 0.50 max. | balance |
| Aim Chemistry | 0.675 | 0.70 | 0.40 | LAP* | LAP* | 0.025 | — | 13.0 | 0.10 | balance |

*Low as possible

Experiments were performed to determine the process parameters (temperatures, times, etc.) necessary to dissolve large primary carbides and produce a uniform secondary carbide distribution in steels within the base chemistry of Table 1. Further investigation was undertaken to determine a processing regimen to reduce ingots of materials within the base chemistries of Table 1 to approximately 0.003 inch gage, while avoiding excessive edge checking and retaining the favorable microstructure achieved by the high temperature processing. Two 50 lb. VIM heats (heats RV1661 and RV 1662) of type 420 stainless steel within the base specifications of Table 1 were prepared having the actual chemistries in Table 2.

TABLE 2

| Heat | C | Mn | Si | P | S | N | B | Cr | Ni | Fe |
|---|---|---|---|---|---|---|---|---|---|---|
| RV1661 | 0.65 | 0.66 | 0.43 | .005 | .0038 | .028 | .0004 | 13.16 | 0.12 | balance |
| RV1662 | 0.69 | 0.71 | 0.39 | .006 | .004 | .021 | .0002 | 13.07 | 0.13 | balance |

An ingot was cast from heat RV1661, allowed to cool to room temperature, and then reheated to 2300° F. for three hours time-at-temperature (T.A.T.) before hot rolling. The ingot cast from heat RV1662 was hot transferred, reheated, and rolled to a 0.140 inch hot band before it was allowed to cool to room temperature. Although the cast microstructure of the ingot from heat RV1661 contained numerous large carbides, samples of the hot band from heat RV1662 did not. After it was re-heated to 2300° F., held for 3 hours T.A.T, and then rolled to 0.140 inch hot band, the microstructure of the RV1661 material was identical to that of the material of heat RV1662. Thus, a three hour heat treatment at 2300° F. dissolved the primary carbides present in the air-cooled ingot and adequately addressed the problem of retention of large primary carbides in the hot band.

the bands did not materially affect the microstructure achieved by the 2300° F. reheat.

Ingots produced and rolled in a commercial scale mill also were evaluated. A 14,000 lb. melt (melt 0507876) was prepared by VIM to the aim and actual chemistries set forth in Table 3. Although VIM was used to produce the melt, it will be understood that any other suitable method for preparing a melt (such as, for example argon oxygen decarburization) may be used.

TABLE 3

| | C | Mn | P | S | Si | Cr | Ni | Al | Mo | Cu | Ti | N | Pb | Sn | B | Cb |
|---|---|---|---|---|---|---|---|---|---|---|---|---|---|---|---|---|
| Actual | 0.69 | 0.59 | 0.011 | 0.005 | 0.46 | 13.05 | 0.13 | 0.01 | 0.01 | 0.01 | 0.002 | 0.021 | .0007 | 0.004 | .0004 | .003 |
| Aim | 0.68 | 0.65 | 0.012 | LAP | 0.3 | 13.1 | 0.1 | LAP | LAP | LAP | LAP | 0.025 | LAP | LAP | LAP | LAP |

Figure 2:
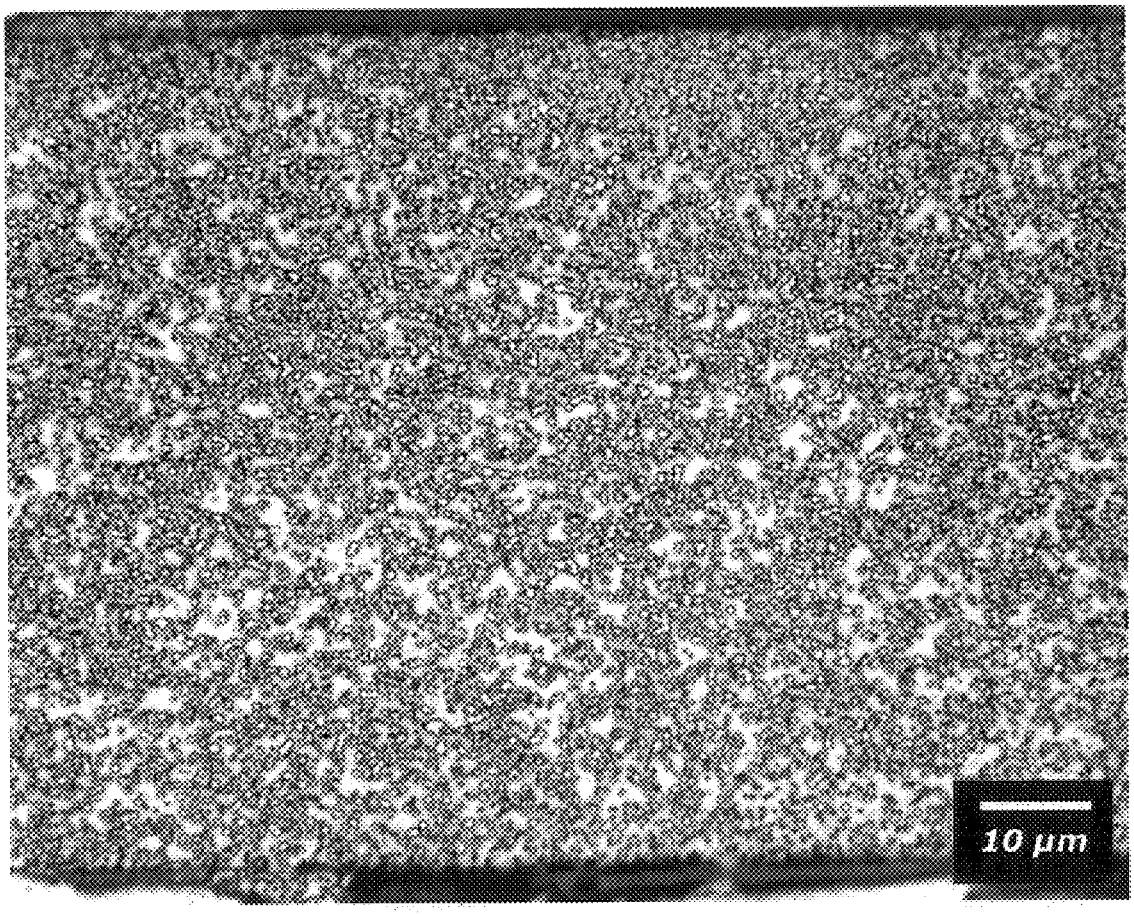
FIG. 2 is a photomicrograph (1500×) of a sample of conventional material used commercially in razor blade applications.
Figure 3:
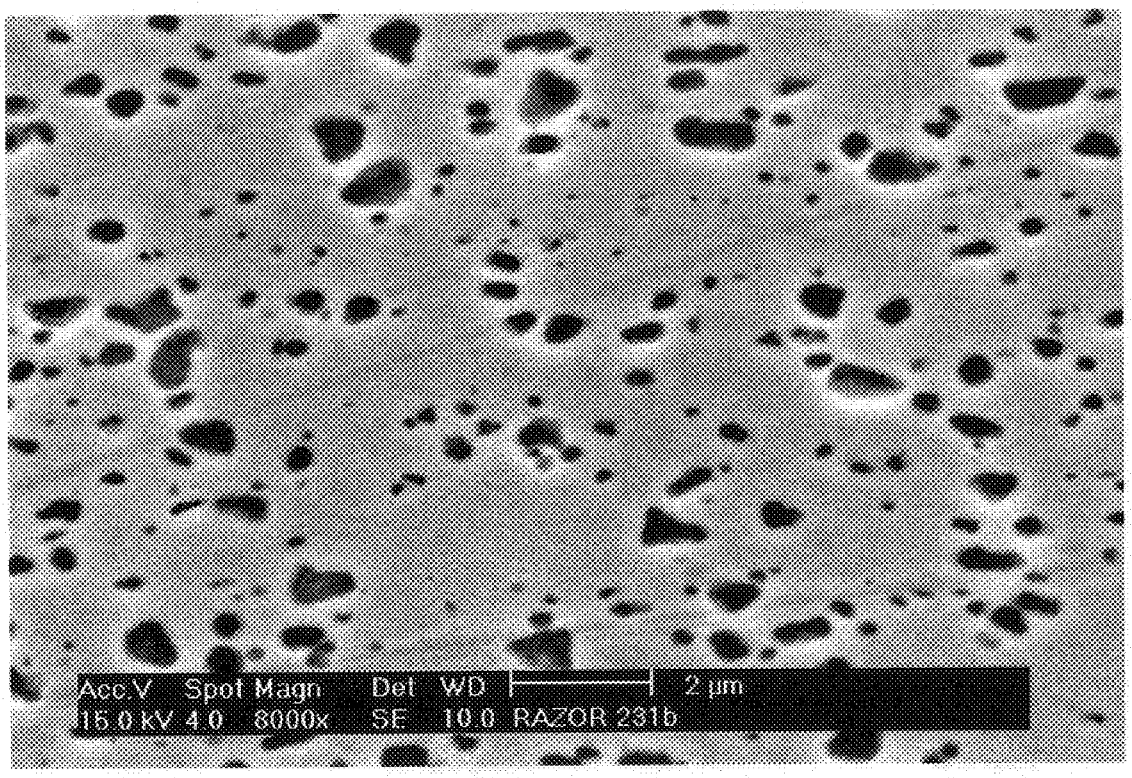
FIG. 3 is an SEM micrograph (8000×) of a sample of material from heat RV1663 processed to 0.003 inch gage.
Figure 4:
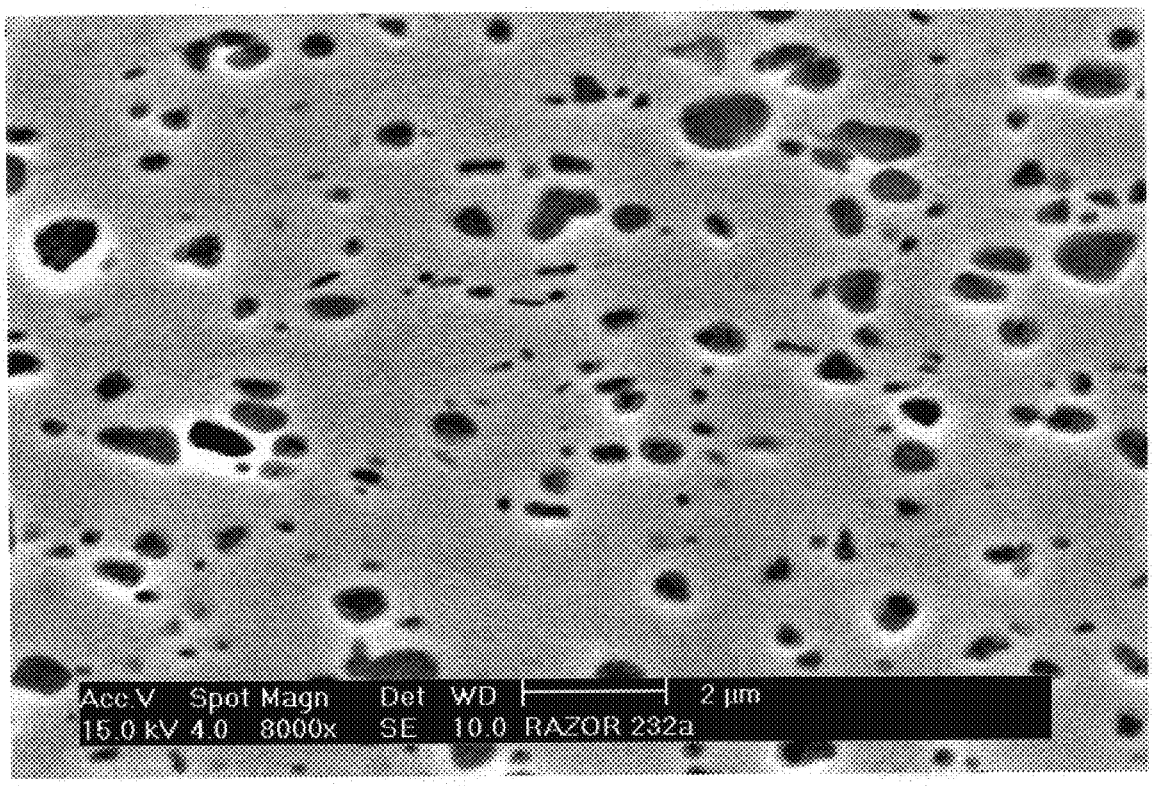
FIG. 4 is an SEM micrograph (8000×) of a sample of material from heat RV1664 processed to 0.003 inch gage.
Figure 5:
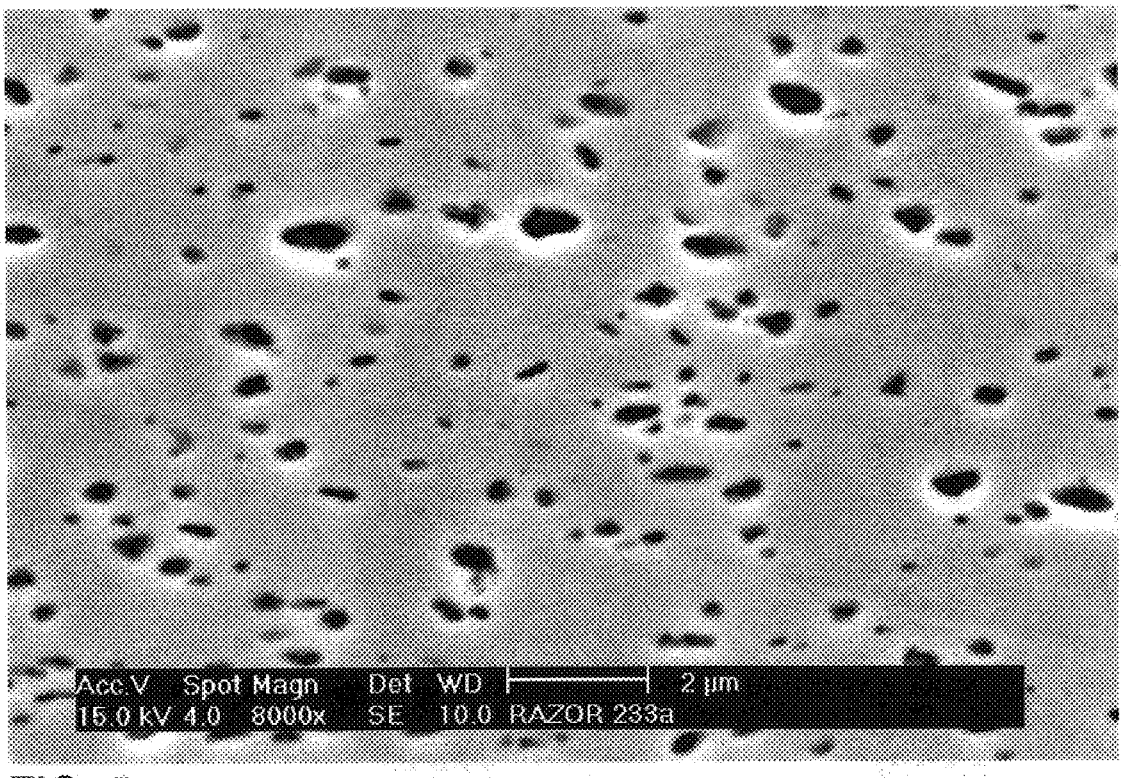
FIG. 5 is an SEM micrograph (8000×) of a sample of material from heat RV1665 processed to 0.003 inch gage.
Figure 6:
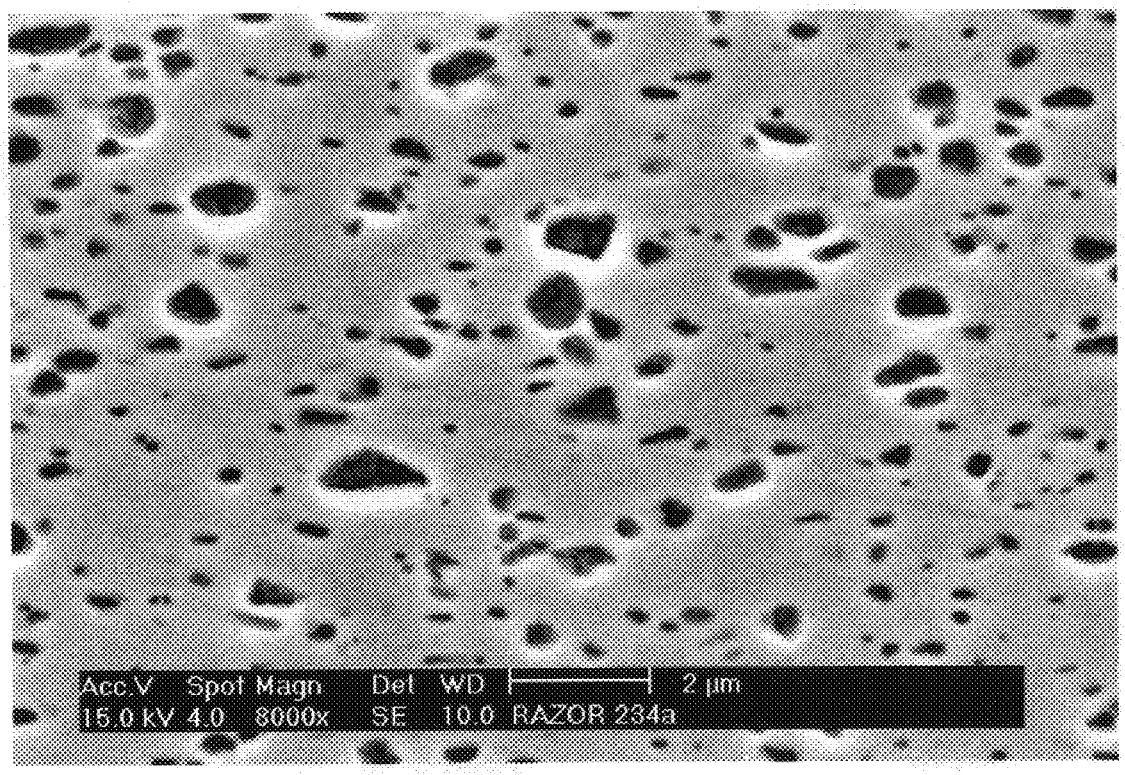
FIG. 6 is an SEM micrograph (8000×) of a sample of material from heat RV1666 processed to 0.003 inch gage.

The microstructures of the 0.140 inch hot bands produced from the material of heats RV1661 and RV1662 consisted of a decarburized outer layer of martensite and an interior consisting mostly of retained austenite and containing about 15–20% martensite and a grain boundary phase assumed to be carbides. The material in the hot bands was brittle and could not be cold rolled without cracking. Therefore, portions of the hot band from heat RV1662 were subjected to a box anneal by slowly heating the portions to 1400° F., holding at temperature for ten hours, and slowly cooling. This procedure allowed the austenite and martensite in the material to decompose into ferrite and carbides. The box annealed hot band was blast and pickled to remove surface scale. Significant edge checking occurred on cold rolling and, therefore, cold rolling was repeated after the hot band had been edge trimmed and annealed for two minutes T.A.T. at 1400° F. In that condition, the material was successfully cold rolled from the hot band to 0.060 inch. The short annealing step significantly reduced the degree of edge checking in cold rolling to the 0.060 inch material. The cold rolled 0.060 inch material was then edge trimmed, annealed again for 2 minutes at 1 400° F. T.A.T., and cold rolled to 0.024 inch. The 0.024 inch material was edge trimmed and annealed, cold rolled to 0.009 inch, edge trimmed and annealed, and finally cold rolled to 0.003 inch and annealed. The microstructure of the 0.003 inch material following the final anneal is shown in FIG. 1 at 1500× magnification. Primary carbides in the material had been dissolved during the three hour 2300° F. soak, and the secondary carbide particles within the material remained uniform and evenly distributed at each stage in the reduction to final gage, properties important to avoiding fracture and tear outs when used in razor blade applications. The cleanliness of the material at final gage also was acceptable. The microstructure of the 0.003 inch gage material (FIG. 1) compared favorably to that observed in a sample of conventional stainless steel used commercially in razor blade applications (FIG. 2). The materials produced from heats RV 1661 and 1662 included averages of 187 (RV 1661) and 159 (RV 1662) carbide particles per 100 micron square area viewed at 8000× magnification. The average carbide particle count for the conventional material, measured in the same way, was 168. Thus, the inventors concluded that a high temperature reheat to a temperature of at least about 2300° F. and below the solidus temperature of the steel may be utilized to achieve a microstructure suitable for razor blade applications. Subsequent lower temperature stress relief anneals used to facilitate cold rolling without breakage of Two 7,000 lb. ingots were cast from the melt. One 7,000 lb. ingot was subjected to a stress relief anneal at 1250° F. for 6 hours T.A.T. The ingot was then subjected to an electroslag remelt (ESR) treatment to remove inclusions and increase homogeneity within the ingot. ESR involves contacting an electrode of the material to be refined with a slag in an open bottomed refining vessel. Electric current is passed through a circuit including the electrode and the slag, heating both. The material melts at its point of contact with the heated slag, and droplets of the melted material pass through the slag and are collected. The material is refined as it passes through and contacts the heated conductive slag. The basic components of a typical ESR apparatus include a power supply, an electrode feed mechanism, an open-bottom water cooled vessel, and a slag. The specific slag type used will depend on the particular alloy being refined. ESR treatment is well known and widely used, and the operating parameters that will be necessary for any particular metal or alloy may readily be ascertained by one having ordinary skill in the art. Accordingly, further discussion of the manner of construction or mode of operation of an ESR apparatus or the particular operating procedure used for a particular alloy is unnecessary.

The ESR treatment used in the present process reduced segregation within the ingot and allowed the ingot to cool quickly, thereby limiting the size of primary carbides formed in the ingot. The smaller carbides may be dissolved more readily at temperatures below the solidus temperature of the ingot material. The ingot resulting from the ESR treatment was 13 inches in diameter. Although ESR was used, other suitable remelting techniques, such as vacuum arc remelting, may be used.

The electroslag remelted ingot was stress relief annealed at 1250° F. for 8 hours T.A.T. The stress relief anneal reduced residual stresses within the ingot to prevent cracking of the slab. Preferably, the stress relief anneal is conducted at a temperature that is not so high as to coarsen carbides within the ingot. The ends of the annealed ingot were cut, reducing ingot weight by approximately 25%. The cut ends were used to develop a mill-scale thermal treatment that will effectively dissolve primary carbides and suitably distribute secondary carbides within the ingot. The annealed ingot was then reheated to 2250° F.+/−25° for one hour minimum T.A.T. and hot rolled to a slab size of 6×33 inches in cross-section. The reheat temperature was below the solidus temperature of the material to prevent mushiness. The slab was then stress relief annealed at 1250° F. for 8 hours T.A.T. The annealed slab subsequently was subjected to a 12 grit contour grind to remove surface scale, and any edge defects were removed by grinding.

Experiments using the end samples previously removed from the 6 inch slab indicated that a temperature in the range of 2300° F. to about 2400° F., and preferably 2300–2350° F., for at least 3 hours T.A.T. is sufficient to dissolve primary carbides in large ingots (one thousand pounds or greater) of the mill heat material. It is believed that such temperature ranges also may be used to dissolve carbides within large ingots of any type 420 stainless steel. More generally, the inventors concluded that primary carbides in a large ingot of any alloy may be suitably dissolved by subjecting the ingot to a temperature at least as great as the lowest temperature at which all of the carbides that may form in the ingot will dissolve and no greater than the nil ductility temperature of the ingot material. Such temperatures may be determined for a particular material by one of ordinary skill without undue effort. The ingot is maintained at the temperature for a period of time sufficient to suitably dissolve carbides. Material subjected to a temperature above the nil ductility temperature will generally include too much liquid to allow the material to be rolled satisfactorily. The nil ductility temperature of a material is the temperature at which there is zero elongation (i.e., the material fractures without elongation) when a sample of the material is placed in tension under the following conditions: a 4.25 inch long, 0.25 inch diameter cylindrical bar of the material is heated at 100° F./second to test temperature, held for 60 seconds at temperature, and pulled to fracture with a crosshead separation rate of 5 inches/second.

Nil ductility tests were performed on material from the 13 inch ingot produced from melt 057876 at nil ductility test temperatures of 2250, 2275, 2300, and 2350° F. The tests indicated a nil ductility temperature of approximately 2200° F. for the 13 inch ingot material. However, after the 13 inch ingot was broken down into a 6 inch slab, it was able to be hot rolled following a 2350° F. reheat. These results indicate that reducing the ingot thickness by rolling increases the nil ductility temperature. That is significant because, as a very general approximation, increasing the temperature of the carbide dissolution step in the present process by 50° F. reduces by 50% the time-at-temperature necessary to suitably dissolve primary carbides. Thus, it would require an unsatisfactorily long time to dissolve primary carbides at 2200° F. Breaking down an ingot into a slab of approximately 50% of its thickness reduces the nil ductility temperature and allows the carbide dissolution step to be carried out at a substantially higher temperature for a significantly shorter time.

The 6 inch slab of the melt 057876 material was charged into a reheat furnace and reheated at 2350° F. for 3 hours T.A.T. and then immediately hot rolled to 0.120 inch–0.125 inch thickness and coiled. A sample was cut at the transfer bar stage, when the material was approximately 1 inch thick, and analyzed by SEM. No signs of primary carbides or large clusters of carbides were detected, nor were many inclusions present. This confirmed that a three-hour hold at a temperature of at least about 2350° F. is sufficient to dissolve primary carbides in the microstructure for the material that was processed. Liquefaction occurred at the grain boundaries during the carbide dissolution heat treatment, but that fact did not negatively affect the hot rolling of the material or the quality of the hot band, which indicates that some amount of incipient melting is tolerable. The T.A.T. effective to suitably dissolve primary carbides would be longer for larger carbides. The size of carbides typically increases as the ingot size increases because larger ingots cool more slowly during solidification.

Next, the coil of 0.120 inch–0.125 inch material was box annealed in a furnace at 1375° F. for 48 hours. Preferably, the furnace temperature should not exceed 1400° F. to avoid carbide coarsening, and the T.A.T. may be as little as 10 hours at 1375° F. The coil was edge trimmed as needed to avoid edge checks and breakage during cold reduction, and then again box annealed at 1375° F. for a total time of 36 hours. As with the previous box anneal, the temperature preferably should not exceed 1400° F. Although a box anneal was used, a line anneal, for example, also could be used and would speed the process. The annealed coil was then blasted and pickled to remove surface scale and corrosion. To reduce the material to the desired 0.003 inch gage, successive incremental cold rolling steps followed by line anneal steps were used, with edge trimming to remove checks as needed.

The ESR step is believed to work in conjunction with the above-described carbide dissolution reheat step to remove essentially all primary carbide particles from the microstructure and create suitable secondary carbide size, shape, distribution, and concentration in large (one thousand pounds or greater) ingots. The electroslag remelting step not only enhanced ingot purity, but also provided a more homogeneous, uniform ingot having a reduced level of segregation of carbon and other components. It is believed that the reduced carbon segregation achieved by the ESR step reduced the size of primary carbides within the material. Thus, the ESR treatment provided the benefits of increased purity and homogeneity and inhibition of the growth of primary carbides. The smaller sized primary carbides are more easily dissolved during the 2300–2350° F. reheat step at shorter T.A.T. Although the foregoing process utilized VIM and ESR to produce a clean ingot, it is believed that an AOD and ESR process may be substituted, at lower cost at high volumes, with a comparable level of microinclusions and primary carbides in the final coil.

Investigations were conducted to determine the effect on microstructure that occurs using alternate chemistries of type 420 steels processed to thin gage by the method of the invention. Four 50 lb. VIM ingots (RV 1663 through 1666) of high carbon type 420 material within the base chemistry of Table 1 (with certain minor exceptions) and having modified boron and nitrogen levels were prepared with the chemistries in Table 4. A primary objective was to assess the effect on primary carbide content and carbide distribution of additions of boron and/or nitrogen to type 420 material within the base chemistry of Table 1. The alternate chemistries included a nitrogen addition and/or a boron addition greater than expected maximum residual impurity amounts of those elements. The expected maximum residual impurity level of nitrogen and boron for conventional type 420 material is about 0.02 and 0.0004 weight percent, respectively. Three of the alternate chemistries included greater than 0.03 up to about 0.20 weight percent nitrogen. Each of the alternate chemistries included at least 0.0004 up to about 0.006 weight percent boron. The base chemistry of Table 1 and the chemistry of heat RV1661 are provided in Table 4 for purposes of comparison with the alternate chemistry heats.

TABLE 4

| | C | Mn | Si | P | S | N | B | Cr | Ni |
|---|---|---|---|---|---|---|---|---|---|
| Base Chemistry | 0.65–0.70 | 0.45–0.75 | 0.20–0.50 | 0.025 max. | 0.020 max. | — | — | 12.7–13.7 | 0.50 max. |
| RV1661 | 0.650 | 0.66 | 0.43 | 0.005 | 0.0038 | 0.028 | 0.0004 | 13.16 | 0.12 |
| RV1663 | 0.655 | 0.64 | 0.31 | 0.004 | 0.0038 | 0.0220 | .0051 | 13.33 | 0.14 |
| RV1664 | 0.651 | 0.63 | 0.38 | 0.005 | 0.0050 | 0.1325 | 0.0004 | 13.24 | 0.14 |
| RV1665 | 0.458 | 0.61 | 0.38 | 0.006 | 0.0047 | 0.168 | 0.0006 | 13.37 | 0.14 |
| RV1666 | 0.568 | 0.67 | 0.33 | 0.005 | 0.0042 | 0.137 | 0.0041 | 14.13 | 0.13 |

The ingots formed from the modified chemistry heats were allowed to cool to room temperature. The ingots were ground in preparation for hot processing and then charged into a furnace at 1800° F. The furnace temperature was increased to 2050° F. and finally to a 2300° F. set point. As discussed above, the inventors determined that the 2300° F. set point temperature will dissolve primary carbides within the ingots. The furnace temperature was stabilized at each the 1800° F. and 2050° F. intermediate temperatures prior to increasing to the 2300° F. set point temperature. The alternate chemistry ingots were held for 2 hours at 2300° F. to dissolve primary carbides within the ingots. The 6 inch wide pieces were then hot rolled to 0.150 inch gage hot bands using a series of rolling steps with 2300° intermediate reheats as needed to prevent the material from fracturing during rolling and to reduce stresses on the rolling machinery. The hot bands were air cooled after reaching the aim gage of 0.150 inch, and each hot band was then box annealed in a nitrogen atmosphere by placing a box containing the bands into a 500° F. furnace. The furnace temperature was increased to 1400° F. at the rate of 50° F. per hour and held at 1400° F. for 10 hours. At the completion of the 10 hour period, the box was cooled at 75° F. per hour to 500° F. and then allowed to cool to room temperature. The box annealed hot bands were edge timed and annealed (1400° F., 2 minutes T.A.T.). The trimmed and annealed hot bands were then lightly blasted and pickled, and then cold rolled to 0.060 inch, 0.024 inch, 0.009 inch, and finally 0.003 inch gage. Between each of the cold reduction steps the strips were edge trimmed and then annealed at 1400° F. for 2 minutes T.A.T. in air.

The 0.003 inch final gage strips produced from each of the modified chemistry heats RV1663 through RV1666 were subjected to a final anneal for 2 minutes at 1400° F. and prepared for metallographic examination. Metallographic samples were etched for 3 seconds in 10—10—10 mixed acids and examined using a Nikon Epiphot Metallograph. Additional samples were etched for 45 seconds with Murikami's reagent and examined using a Phillips 1L XL30 FEG scanning electron microscope. Inspection of the as-cast microstructures revealed that the primary carbides formed in the ingots from heats RV1663 and RV1664 are similar in size (mostly less than 1 micrometer in diameter) to those formed in heat RV1661. The primary carbides formed in the ingots of heats RV1665 and RV1666 were smaller than those of heats RV1663 and RV1664, which may be due, in part, to the lower carbon content of heats RV1665 and RV1666.

Figure 7:
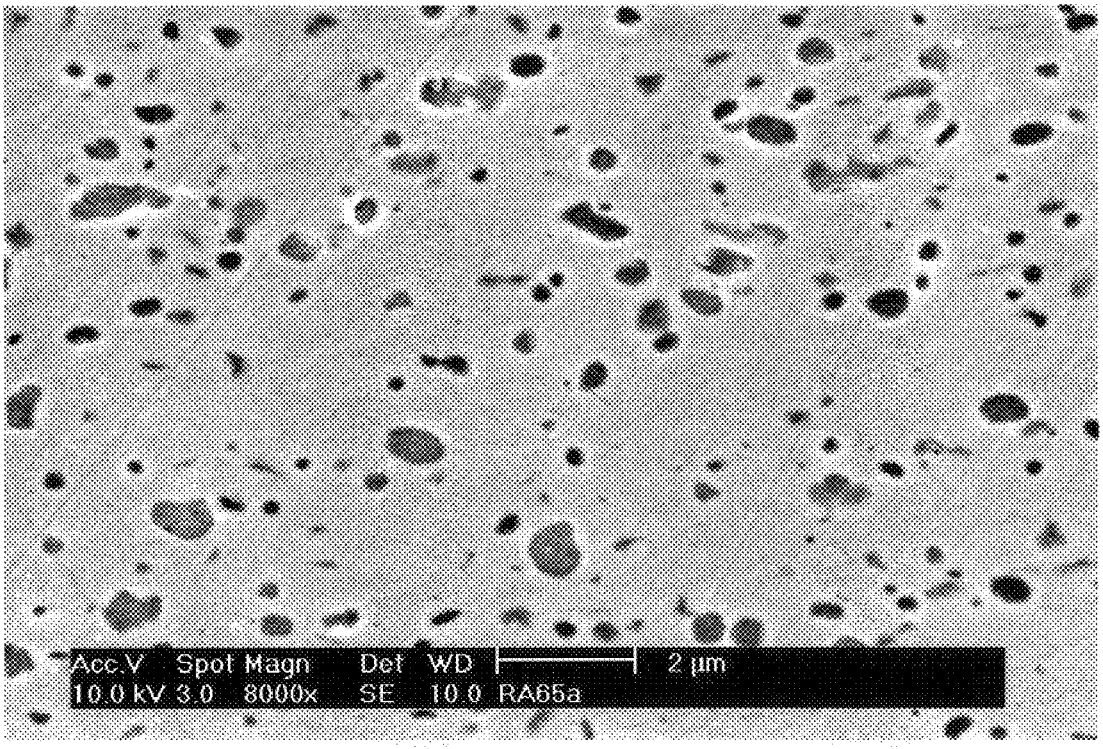
FIG. 7 is an SEM micrograph (8000×) of a sample of conventional stainless steel used in razor blade applications.
Figure 8:
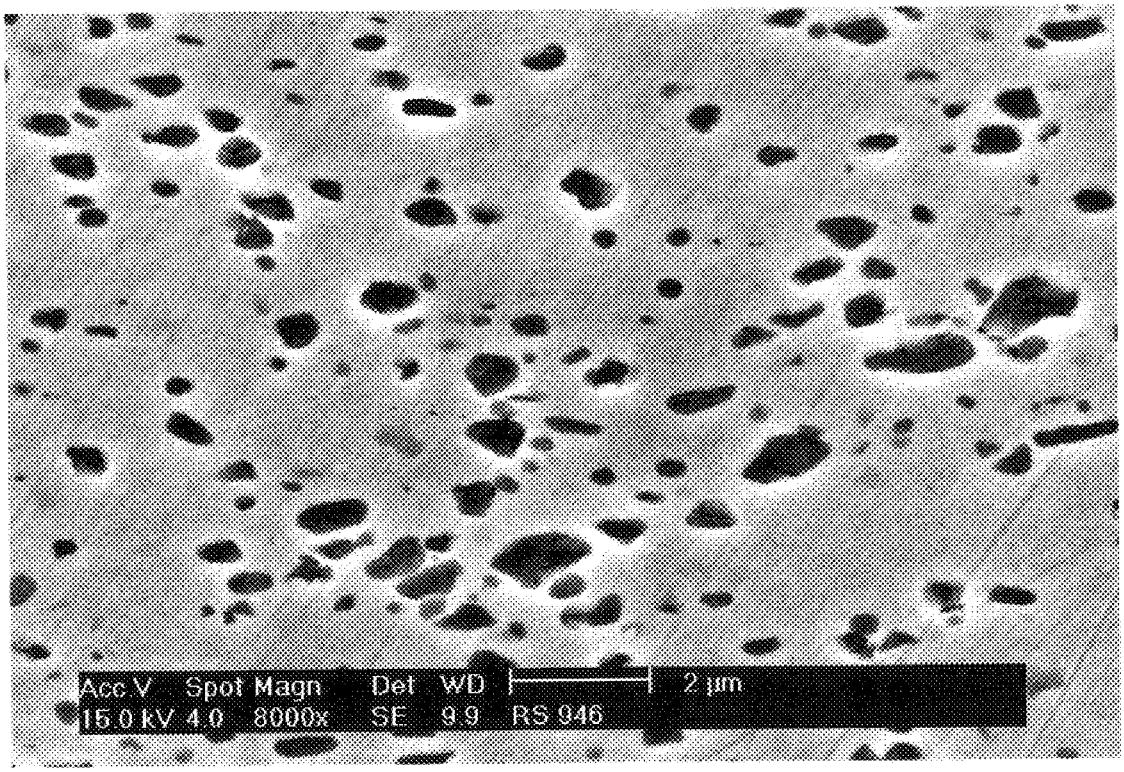
FIG. 8 is an SEM micrograph (8000×) of a sample of material from mill heat 057867 that was rolled from hot rolled band gage to 0.003 inch.

SEM also was used to compare the microstructures of samples of the 0.003 inch strip produced from each of heats RV1663–1666 (FIGS. 3–6, respectively) with both the microstructure of a sample of conventional high carbon martensitic type 420 stainless steel razor blade stock (FIG. 7) and the microstructure of a sample of the material from mill heat (heat 057867) that had been rolled from hot rolled band gage to 0.003 inch (FIG. 8). The approximate chemistry of the conventional martensitic stainless steel was 0.8 Mn, 0.2 P, 0.4 Si, 13.3 Cr, 0.1 Ni, 0.03 Mo, 0.006 Cb, 0.001 Ti, 0.0006 B, 0.7 C, 0.002 S, and 0.028 $N_2$, all in weight percentages. Table 5 lists the measured average number of carbide particles in a 100 micron square area for each of the samples when imaged at 8000×. Table 5 also lists the carbide particle counts for the RV1661 and RV1662 materials. The microstructures of the laboratory and mill heat materials all compared favorably with that of the conventional martensitic stainless steel in terms of secondary carbide size and shape and uniformity of carbide distribution, and the carbide concentrations of each of the experimental samples approximated the concentration calculated for the conventional material.

TABLE 5

| Material | Mill Processed Mill Heat 057867 | Conventional Material | RV 1661 | RV 1662 | RV 1663 | RV 1664 | RV 1665 | RV 1666 |
|---|---|---|---|---|---|---|---|---|
| Avg. # carbides per 100 micron square area | 141 | 168 | 187 | 159 | 179 | 154 | 153 | 194 |

The foregoing analyses of the samples produced from the modified heats RV1663–1666 indicate that levels of boron and/or nitrogen within the aim levels of the modified heats (above residual and up to 0.20 weight percent of nitrogen and/or above residual and up to 0.006 boron) do not materially adversely affect secondary carbide concentration, size, shape, or distribution and do not materially increase the content of primary carbides in materials produced by the processes investigated in the present invention. Thus, it is believed material having boron and/or nitrogen levels greater than in conventional razor blade material is suitable for razor blade applications.

Figure 9:
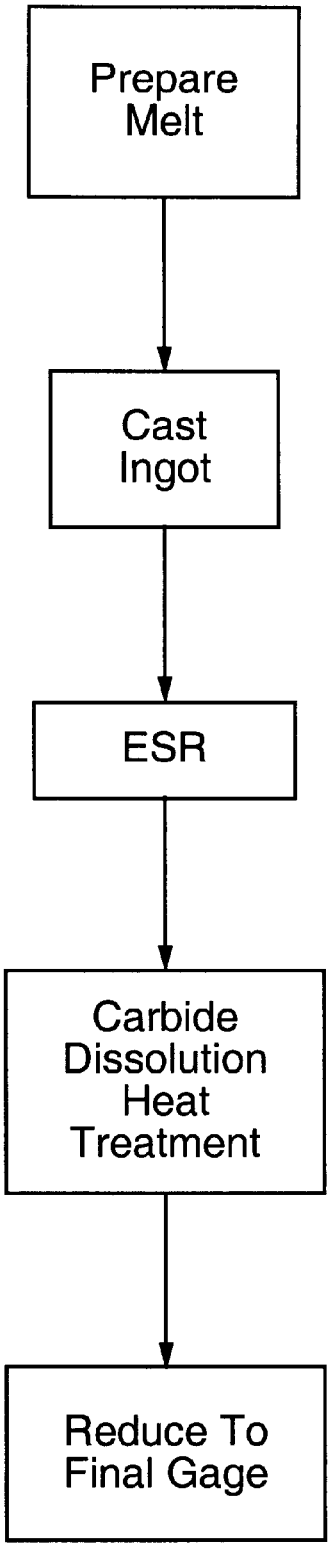
FIG. 9 is a schematic representation of a process of the present invention for producing a martensitic stainless steel having a microstructure suitable for application as razor blade material.

Considering the results of the laboratory and mill heats and the processing of the materials, the process generally outlined in FIG. 9, when applied to a martensitic stainless steel such as, for example, a type 420 steel, may be used to produce a microstructure suitable for razor blade applications. In particular, a melt having a type 420 chemistry is prepared by VIM, AOD, or another suitable method and is cast to an ingot. In a subsequent step, the ingot is electroslag remelted in order to reduce the size of primary carbides in the material and, more generally, reduce segregation and migration of carbon within the ingot. The ESR also augments ingot purity and increases ingot homogeneity. In a step subsequent to the ESR, the material is heated to a temperature in the range of close to the nil ductility temperature of the material up to the solidus temperature of the material. The material is held at that temperature for a time period required to dissolve substantially all primary and clustered carbides. The appropriate time will vary depending on ingot size, and the time and temperature also may vary if the maximum allowable primary carbide particle size is varied. Preferably, the steel should be held at temperature for at least about two hours. If the material is to be used in razor blade applications, the high temperature carbide dissolution step is followed by an appropriate sequence of hot and cold rolling steps. The cold rolling steps are separated by edge trim and anneal combinations as needed to prevent breakage and excessive checking during rolling. As applied in the mill experiment, one or more hot rolling steps may precede the high temperature carbide dissolution step to achieve an intermediate slab thickness. Surface grinding, pickling, trimming, and other steps used in the steel processing arts may be applied as needed.

Accordingly, the present invention provides a process for producing type 420 stainless steel with a microstructure that is substantially free of primary and clustered primary carbides and having a secondary carbide size, shape, and distribution suitable for razor blade applications as described herein. The present invention also provides a process for preparing stainless steel strip from heats of type 420 or other martensitic stainless steel to a gage suitable for razor blade applications (typically less than 10 mils). Although the present invention has been described in connection with certain embodiments, those of ordinary skill in the art will, upon considering the foregoing description, recognize that many modifications and variations of the invention may be employed. In particular, although the foregoing examples of the process of the invention are necessarily applied to a limited number of alloy chemistries, it is believed that the process may be applied to, for example, any of the type 420 martensitic stainless steels with substantially the same results. All such variations and modifications of the present invention are intended to be covered by the foregoing description and the following claims.

What is claimed is:

1. A process for preparing a material, the process comprising;

providing a steel having a chemical composition of a type 420 stainless steel;

melting at least a portion of the steel by an electroslag remelting treatment to provide an ingot of remelted steel;

heating at least a portion of the remelted steel ingot to a temperature at least as great as the lowest temperature at which all of the carbides that can form in the remelted steel will dissolve and no greater than the nil ductility temperature of the remelted steel, and maintaining the temperature for a period of time sufficient to dissolve primary and clustered carbide particles in the remelted steel greater than 15 micrometers in length.

2. The process of claim 1, wherein melting at least a portion of the steel by an electroslag remelting treatment comprises:

providing a vessel containing a slag;

contacting the steel with the slag within the vessel;

passing electric current through a circuit including at least the steel and the slag to heat the steel and the slag by electrical resistance and melt the steel at its contact point with the slag, thereby forming a plurality of droplets of remelted steel; and allowing the plurality of droplets of remelted steel to pass through the heated slag.

3. The process of claim 1, wherein heating at least a portion of the remelted steel comprises heating at least a portion the remelted steel to a temperature of at least 2300° F.

4. The process of claim 1, wherein heating at least a portion of the remelted steel comprises heated the remelted steel at a temperature no greater than 2400° F.

5. The process of claim 1, wherein heating at least a portion of the remelted steel comprises heating at least a portion of the remelted steel for at least 2 hours at a temperature of at least 2300° F. and no greater than 2400° F.

6. The process of claim 5, wherein heating at least a portion of the remelted steel comprises heating at least a portion of the remelted steel at a temperature of at least 2300° F. and no greater than 2350° F.

7. The process of claim 1, wherein providing a steel comprises providing a stainless steel including:

at least 0.15 carbon no greater than 1.0 manganese;

no greater than 1.0 silicon; and 12.0 to 14.0 chromium, all in weight percent based on total weight of the steel.

8. The process of claim 7, wherein providing a steel comprises providing a stainless steel including:

0.65 to 0.70 carbon;

0 to 0.025 phosphorus;

0 to 0.020 sulfur;

0.20 to 0.50 silicon;

0.45 to 0.75 manganese;

12.7 to 13.7 chromium; and 0 to 0.50 nickel, all in weight percent based on the total weight of the steel.

9. The process of claim 8, wherein providing a steel comprises providing a stainless steel consisting essentially of:

0.65 to 0.70 carbon;

0 to 0.025 phosphorus;

0 to 0.020 sulfur;

0.20 to 0.50 silicon;

0.45 to 0.75 manganese;

12.7 to 13.7 chromium;

0 to 0.50 nickel, all in weight percent based on the total weight of the steel; and incidental impurities.

10. The process of any of claims 8 and 9, wherein the steel further comprises at least one of greater than 0.0004 weight percent boron and greater than 0.03 weight percent nitrogen.

11. The process of any of claims 8 and 9, wherein the steel further comprises greater than 0.0004 up to 0.006 weight percent boron.

12. The process of any of claims 8 and 9, wherein the steel further comprises greater than 0.03 up to 0.20 weight percent nitrogen.

13. The process of claim 1, further comprising, subsequent to heating at least a portion of the remelted steel:

reducing a thickness of the steel to a gage of less than 10 mils.

14. The process of claim 12, wherein reducing a thickness of the steel comprises a applying a plurality of rolling reductions and a plurality of anneals to the steel.

15. The process of claim 13, further comprising prior to heating at least a portion of the remelted steel:

heating at least a portion of the remelted steel to 2100° F. to 2300° F. and holding at temperature for at least one hour;

hot rolling to an intermediate gage; and annealing to relieve stresses.

16. A process for preparing a material, the process comprising:

providing a steel having a chemical composition of a type 420 stainless steel;

melting at least a portion of the steel by an electroslag remelting treatment to provide an ingot of remelted steel;

rolling the ingot to reduce a thickness of the ingot by at least 50%; and heating at least a portion of the remelted steel ingot to a temperature at least as great as the lowest temperature at which all carbides that can form in the remelted steel will dissolve and no greater than the nil ductility temperature of the remelted steel, and maintaining the temperature for a period of time sufficient to dissolve primary and clustered carbide particles in the remelted steel greater than 15 micrometers in length.

17. The process of claim 16, wherein heating at least a portion of the remelted steel comprises heating at least a portion of the remelted steel for at least 2 hours at a temperature of at least 2300° F. and no greater than 2400° F.

18. The process of claim 16, wherein melting at least a portion of the steel by an electroslag remelting treatment comprises:

providing a vessel containing a slag;

contacting the steel with the slag within the vessel;

passing electric current through a circuit including at least the steel and the slag to heat the steel and the slag by electrical resistance and melt the steel at its contact point with the slag, thereby forming a plurality of droplets of remelted steel; and allowing the plurality of droplets of remelted steel to pass through the heated slag.

* * * * *